US007767299B2

(12) United States Patent
Easter

(10) Patent No.: US 7,767,299 B2
(45) Date of Patent: Aug. 3, 2010

(54) STRIPPABLE CABLE SHIELD COMPOSITIONS

(75) Inventor: Mark R. Easter, Indianapolis, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 626 days.

(21) Appl. No.: 11/117,395

(22) Filed: Apr. 29, 2005

(65) Prior Publication Data

US 2006/0246286 A1 Nov. 2, 2006

(51) Int. Cl.
*H01B 1/24* (2006.01)
*H01B 7/00* (2006.01)

(52) U.S. Cl. ..... 428/383; 252/511; 428/375; 428/379; 174/110 R; 174/120 C; 174/120 SC; 524/495

(58) Field of Classification Search ..... None
See application file for complete search history.

(56) References Cited

U.S. PATENT DOCUMENTS 6,274,066 B1 * 8/2001 Easter ..... 252/511
6,284,374 B1 9/2001 Yamazaki et al.
6,391,509 B1 5/2002 Drappel et al.
6,402,993 B1 6/2002 Easter
6,491,849 B1 * 12/2002 Easter ..... 252/511
6,623,855 B2 * 9/2003 Hsia ..... 428/379
6,972,099 B2 * 12/2005 Easter ..... 252/511

FOREIGN PATENT DOCUMENTS

EP 0334992 10/1989
EP 0364848 4/1990
EP 1156493 11/2001

* cited by examiner

*Primary Examiner*—Jill Gray
(74) *Attorney, Agent, or Firm*—Blank Rome LLP

(57) ABSTRACT

An insulation shield material is provided having improved performance without the need for expensive additives, complex polymer formulations, or specially prepared carbon black. The semiconductive composition used to make the strippable semiconductive insulation shield layer in contact with the outer surface of a wire and cable insulation layer has a base polymer having a weight average molecular weight of not more than 200,000, an adhesion modifying additive system having at least two components and a conductive carbon black. Each of the adhesion modifying additive system components is different from the base polymer. The first component of the adhesion modifying additive system contains a hydrocarbon wax or ethylene vinyl acetate wax and the second component of the adhesion modifying additive system contains an amide wax.

24 Claims, No Drawings

STRIPPABLE CABLE SHIELD COMPOSITIONS

FIELD OF THE INVENTION

The invention relates to semiconducting insulation shield compositions for electric power cables having a base polymer and a two-component adhesion modifying additive system. The invention also relates to the use of these semiconducting insulation shield compositions to manufacture semiconductive insulation shields for use in electric cables, electric cables made from these compositions and methods of making electric cables from these semiconducting insulation shield compositions. The semiconducting insulation shield compositions of the invention may be used as strippable insulation shields in power cables, primarily with medium voltage cables having a voltage from about 5 kV up to about 100 kV.

BACKGROUND OF THE INVENTION

A typical insulated electric power cable generally comprises one or more conductors in a cable core that is surrounded by several layers of polymeric materials including an inner semiconducting shield layer (conductor or strand shield), an insulating layer, an outer semiconducting shield layer (insulation shield), a metallic wire or tape shield used as the ground phase, and a protective jacket. Additional layers within this construction such as moisture impervious materials, are often incorporated. The invention pertains to the outer semiconducting insulation shield layer, i.e., the insulation shield and cables made with the outer semiconducting insulation shield in accordance with the invention.

In general, semiconducting dielectric insulation shields can be classified into two distinct types, the first type being a type wherein the dielectric shield is securely bonded to the polymeric insulation so that stripping the dielectric shield is only possible by using a cutting tool that removes the dielectric shield alone with some of the cable insulation. This type of dielectric shield is preferred by companies that believe that this adhesion minimizes the risk of electric breakdown at the interface of the shield and insulation. The second type of dielectric shield is the "strippable" dielectric shield wherein the dielectric shield has a defined, limited, adhesion to the insulation so that the strippable shield can be peeled cleanly away from the insulation without removing any insulation. Current strippable shield compositions for use over insulation materials selected from polyethylene, cross-linked polyethylenes, or one of the ethylene copolymer rubbers such as ethylene-propylene rubber (EPR) or ethylene-propylene diene terpolymer (EPDM) are usually based on an ethylene-vinyl acetate (EVA) copolymer base resin rendered conductive with an appropriate type and amount of carbon black.

Strippable shield formulations of EVA and nitrile rubbers have been described by Ongchin, U.S. Pat. Nos. 4,286,023 and 4,246,142; Burns et al. EP Application No. 0,420,271B, Kakizaki et al U.S. Pat. No. 4,412,938 and Janssun, U.S. Pat. No. 4,226,823, each reference being herein incorporated by reference into this application. A problem with these strippable shield formulations of EVA and nitrile rubber is that the EVA's needed for this formulation have a relatively high vinyl acetate content to achieve the desired adhesion level with the result that the formulations are more rubbery than is desired for high speed extrusion of a commercial electric cable.

Alternative adhesion-adjusting additives have also been proposed for use with EVA, for example waxy aliphatic hydrocarbons (Watanabe et al. U.S. Pat. No. 4,933,107, herein incorporated by reference); low-molecular weight polyethylene (Burns Jr., U.S. Pat. No. 4,150,193 herein incorporated by reference); silicone oils, rubbers and block copolymers that are liquid at room temperature (Taniguchi et al. U.S. Pat. No. 4,493,787 herein incorporated by reference); chlorosulfonated polyethylene, ethylene-propylene rubbers, polychloroprene, styrene-butadiene rubber, and natural rubber. However, the only adhesion-adjusting additives that appear to have found commercial acceptance have been paraffin waxes.

U.S. Pat. No. 6,284,374 to Yamazaki, et al discloses a multi-component polymer composition for use in strippable semiconductive shields suitable for a polyolefin-insulated wire and cable crosslinked by silane grafting/water crosslinking. The main polymer component of the composition is mainly composed of an ethylene/vinyl acetate copolymer having a weight average molecular weight not less than 300,000.

Commonly assigned U.S. Pat. Nos. 6,274,066 and 6,013,202 disclose a strippable semiconductive shield made from a base polymer and an adhesion modifying additive.

US Published Patent Application 2004/0217329A1 to Easter discloses a two component base polymer together with adhesion adjusting additives WO 2004/088674 A1 to Person discloses a strippable semiconductive shield made from a base polymer which is a soft polymer and a hard polymer.

The use of amide wax additives in a conductor shield has been proposed in commonly assigned U.S. Pat. No. 6,491,849 to Easter to improve aging characteristics of the electric cable.

In the manufacture of commercial quantities of electric cable, minor cost improvements to polymeric compositions where the resulting composition and/or cable employing the composition have acceptable physical or electric properties are considered significant advances in the art. This is because the competitive environment places great demands on product pricing as well as performance and longevity. An improvement which not only reduces cost but improves properties is considered extremely significant, as it positively impacts both cost and quality.

It would be desirable to develop lower cost, easier to compound, strippable semiconductive insulation shield compositions. Other proposals require complicated compounding methods or additives that are, on average, twice as expensive as the base polymers when used to achieve lower adhesion and/or strippability.

A novel two component adhesion modifying additive system for strippable insulation shields is proposed which provides remarkable adhesion results while also improving cost over earlier systems.

SUMMARY OF THE INVENTION

The invention provides an insulation shield material with improved performance without the need for expensive additives, complex polymer formulations, or specially prepared carbon black.

The invention also provides a semiconductive composition for use as a strippable semiconductive insulation shield layer in contact with the outer surface of a wire and cable insulation layer, the composition comprising a base polymer having a weight average molecular weight of not more than 200,000 and an adhesion modifying additive system comprising at least two components, each of said an adhesion modifying additive system components being different from said base polymer, said first component comprising a hydrocarbon wax or ethylene vinyl acetate wax and said second component comprising an amide wax; and a conductive carbon black.

In embodiments of the invention the base polymer is selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons, and mixtures thereof. Preferably the base polymer comprises ethylene vinyl acetate copolymer having from about 28% to about 40% vinyl acetate.

In preferred embodiments of the invention the first component of the adhesion modifying additive system is an ethylene vinyl acetate wax having a vinyl acetate content of from about 10% to about 20% vinyl acetate.

The amide wax may be selected from stearamide, oleamide, erucamide, ethylene bis-stearamide, ethylene bis-oleamide, ethylene bis-erucamide, behenamide, and mixtures thereof.

An electrically conductive cable utilizing the insulation shield in accordance with the invention is also provided.

DETAILED DESCRIPTION OF THE INVENTION

Conventional electrical insulators used in medium voltage cables include polyethylenes, cross-linked polyethylenes (XLPE), ethylene-propylene rubbers and ethylene propylene diene rubbers (EPDM rubbers). The term polyethylene is meant to include both polymers and copolymers wherein ethylene is the major component, this would include, for example metallocene or single site catalyzed ethylenes that are copolymerized with higher olefins.

The polymers (other than those described below for use in the semiconductive composition for use as a strippable semiconductive insulation shield layer in accordance with the invention) utilized in the protective jacketing, insulating, conducting or semiconducting layers of the inventive cables may be made by any suitable process which allows for the yield of the desired polymer with the desired physical strength properties, electrical properties, tree retardancy, and melt temperature for processability.

The strippable semiconductive insulation shields of the invention comprise a base polymer, a two-component adhesion modifying additive system and conductive carbon blacks. The conductive carbon blacks are added in an amount sufficient to decrease the electrical resistivity to less than 550 ohm-meter. Preferably the resistivity of the semiconductive shield is less than about 250 ohm-meter and even more preferably less than about 100 ohm-meter.

Shield Polymers

The invention provides a semiconductive resin composition for use as a semiconductive layer in contact with a wire and cable insulation layer. The resin composition comprises about 40 to about 85 weight percent, based upon the weight of the semiconductive resin composition, of a base polymer.

The base polymer has a weight average molecular weight of not more than 200,000, preferably not more than 150,000 and more preferably not more than 100,000.

The base polymer may be selected from ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons.

The ethylene vinyl acetate copolymer used in the base polymer can be any EVA copolymer with the following properties: the ability to accept high loadings of conductive carbon filler, elongation of 150 to 250 percent and sufficient melt strength to maintain its shape after extrusion. EVA copolymers with vinyl acetate levels above about 25 percent and below about 45 percent having these properties are known. Accordingly, the EVA copolymers in accordance with the invention can have a vinyl acetate percentage range of about 25 to 45 percent. A preferred EVA copolymer will have a vinyl acetate percentage range of about 25 to 40 percent and an even more preferred EVA copolymer will have a vinyl acetate percentage of about 28 to 40 percent, most preferably about 28 to about 33 percent.

The ethylene alkyl acrylate copolymers used in the base polymer can be any suitable ethylene alkyl acrylate copolymers with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl acrylate copolymers with alkyl acrylate levels above about 25 percent and below about 45 percent have these properties. The ethylene alkyl acrylate copolymers can have an alkyl acrylate percentage range of about 25 to 45 percent. A preferred ethylene alkyl acrylate copolymer will have an alkyl acrylate percentage range of about 28 to 40 percent and an even more preferred ethylene alkyl acrylate copolymer will have an alkyl acrylate percentage of about 28 to 33 percent. The ethylene alkyl acrylate copolymer used in the base polymer has a weight average molecular weight of not more than 200,000, preferably not more than 150,000 and more preferably not more than 100,000.

The ethylene alkyl methacrylate copolymers used in the base polymer can be any suitable ethylene alkyl methacrylate copolymer with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl methacrylate copolymers with alkyl methacrylate levels above about 25 percent and below about 45 percent have these properties. The ethylene alkyl methacrylate copolymers can have an alkyl methacrylate percentage range of about 25 to 45 percent. A preferred ethylene alkyl methacrylate copolymer will have an alkyl methacrylate percentage range of about 28 to 40 percent and an even more preferred ethylene alkyl methacrylate copolymer will have an alkyl methacrylate percentage of about 28 to 33 percent.

The ternary copolymers of ethylene with alkyl acrylates and alkyl methacrylates used in the base polymer can be any suitable ternary copolymer with the following properties: the ability to accept high loadings of conductive carbon filler, elongation of 150 to 250 percent and sufficient melt strength to maintain its shape after extrusion. The alkyl group can be any alkyl group independently selected from the C1 to C6 hydrocarbons, preferably the C1 to C4 hydrocarbons and even more preferable methyl. Usually a ternary copolymer will be predominantly either an alkyl acrylate with a small portion of an alkyl methacrylate or an alkyl methacrylate with a small portion of an alkyl acrylate. The proportions of alkyl acrylate and alkyl methacrylate to ethylene will be about the same as the proportions described for ethylene alkyl acrylate copolymers or for ethylene alkyl methacrylate copolymers as well as the molecular weight ranges described for ethylene alkyl acrylate and ethylene alkyl methacrylate.

The adhesion modifying additive system comprises at least two components, each of the adhesion modifying additive system components being different from the base polymer. The first component comprises a hydrocarbon wax or ethylene vinyl acetate wax and the second component comprises an amide wax.

Suitable hydrocarbon waxes and ethylene vinyl acetate waxes for use in the invention are disclosed in commonly assigned U.S. Pat. Nos. 6,274,066 and 6,402,993, the disclosures of which are incorporated herein by reference. EP0334992 to Watanabe and U.S. Pat. No. 4,150,193 to Burns, the disclosures of which are incorporated herein by reference, also disclose suitable hydrocarbon waxes and ethylene vinyl acetate waxes for use in the invention. In preferred embodiments, the semiconductive composition adhesion modifying additive system has an ethylene vinyl acetate wax having a vinyl acetate content of from about 10% to about 20% vinyl acetate, more preferably about 14%, and most preferably about 11%. One of the advantages of the invention is that the more expensive 14% vinyl acetate wax can be replaced with the less expensive 11% vinyl acetate wax (in combination with the amide wax additive component) while still maintaining performance. In other preferred embodiments the first component additive is an ethylene vinyl acetate (EVA) wax and has a molecular weight from about 15,000 Daltons to about 40,000 Daltons and a vinyl acetate content of from about 2% to about 28%, preferably from about 10% to about 20%. In other preferred embodiments, the EVA wax has a molecular weight from about 15,000 Daltons to about 30,000 Daltons and a vinyl acetate content of from about 12% to about 15%.

The ethylene vinyl acetate wax or hydrocarbon wax is about 0.5 to about 5 weight percent, based upon the weight of the semiconductive composition, preferably about 1 to about 3 weight percent, based upon the weight of the semiconductive composition. Mixtures of ethylene vinyl acetate waxes and/or hydrocarbon waxes may be used as well.

The amide wax is about 0.5 to about 5 weight percent, based upon the weight of the semiconductive composition, preferably about 1 to about 3 weight percent, based upon the weight of the semiconductive composition. Mixtures of amide waxes may be used as well.

The present invention is based upon the discovery that certain waxes in combination produce a shield composition having enhanced strippability. The amide waxes of the invention, i.e., the second component of the additive system, are selected from stearamide, oleamide, erucamide, ethylene bis-stearamide, ethylene bis-oleamide, ethylene bis-erucamide, behenamide, oleyl palmitamide, and mixtures thereof. Refined erucamides, refined oleamides, ethylene bis-stearamide and blends of ethylene bis-stearamide and ethylene bis-oleamide are preferred.

In the present invention, commercially available, conventional carbon black is added to the polymer compositions to impart semi-conductive properties to the composition. The carbon black added to the polymer may be one of the various available conventional carbon blacks, including finely divided carbon such as lamp black, furnace black, or acetylene black, i.e. carbon black made by pyrolyzing acetylene. Ketjin black may be used in the compositions of the invention as well as many of the commercial carbon black grades described in ASTM D 1765 98b, for example, N351, N293 and N550. Preferably, to avoid problems associated with carbon black dust, the carbon black is pelletized, although non-pelletized carbon black, such as in its fluffy form, may also be used with equal success. The carbon black is generally present in the composition in the amount of from about 0.1% to about 65% by weight of the polymer composition. Preferably the carbon black is present in an amount of from about 10% to about 50% by weight, based on the weight of the total composition.

A tremendous number of compounds have been suggested for use as additives in semiconducting shield compositions. Typically, these compounds fall into the category of antioxidants, curing agents, vulcanizing agents, crosslinking agents, boosters and retardants, processing aids, pigments, dyes, colorants, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators.

All of the components of the compositions utilized in the invention are usually blended or compounded together prior to their introduction into an extrusion device from which they are to be extruded onto an electrical conductor. The polymer and the other additives and fillers may be blended together by any of the techniques used in the art to blend and compound such mixtures into homogeneous masses. For instance, the components may be fluxed on a variety of apparatus including multi-roll mills, screw mills, continuous mixers, compounding extruders and Banbury mixers.

After the various components of the composition are uniformly admixed and blended together, they are further processed to fabricate the cables of the invention. Prior art methods for fabricating polymer insulated cable and wire are well known, and fabrication of the cable of the invention may generally be accomplished any of the various extrusion methods.

In a typical production method of, for example, a peroxide cross-linked insulation layer of a cable, an (optionally) heated conducting core to be coated is pulled through a heated extrusion die, generally a cross-head die, in which a layer of melted polymer is applied to the conducting core. Upon exiting the die, the conducting core with the applied polymer layer is passed through a heated vulcanizing section, or continuous vulcanizing section where they are completely cross-linked in a short time, and then a cooling section, generally an elongated cooling bath, to cool. Multiple polymer layers may be applied by consecutive extrusion steps in which an additional layer is added in each step, or with the proper type of die, multiple polymer layers may be applied simultaneously. The semiconductive shield, insulating layer and strippable semiconductive shield are then passed through a heated vulcanizing section, or continuous vulcanizing section where all three layers are cross-linked simultaneously and then a cooling section, generally an elongated cooling bath, to cool. The vulcanizing section is heated as hot as possible without thermally decomposing the polymer layers of the cable.

In other production methods for producing a peroxide cross-linked insulation layer of a cable, the extruded core and polymer layers are passed through a heated salt bath or an electron beam section where all three layers are cross-linked simultaneously. In yet another method, the extruded core and polymer layers are passed through a heated bath of lead or heated lead is extruded over the core and the heat energy in the lead cures the cable in a short time.

In contrast, moisture crosslinked cables are typically extruded directly into a elongated cooling trough and cooled in an uncross-linked state. The process used is the same as that for the production of a thermoplastic cable that is not cross-linked. The moisture cross-linkable cable is then placed in a bath of hot water or in a source of steam, sometimes referred to as a "sauna", where it slowly cures over time. The rate of cure is dependent on the thickness and the moisture permeability of the layers of the cable and the type of catalyst used and can range from several hours to several days. While heat slightly increases the rate at which water permeates the cable, the temperature must be kept below the melting point of the outer layer of the cable to prevent it softening and sticking to itself. Because of this moisture cure is undesirable for cables of higher voltage that require thicker layers of insulation. The number of water tanks or saunas required becomes too great.

The conductor of the invention may generally comprise any suitable electrically conducting material, although generally electrically conducting metals are utilized. Preferably, the metals utilized are copper or aluminum. In power transmission, aluminum conductor/steel reinforcement (ACSR) cable, aluminum conductor/aluminum reinforcement (ACAR) cable, or aluminum cable is generally preferred.

The weight average molecular weight may be measured by light scattering or by other conventional means. The number average molecular weight may be measured by osmometry or by other conventional means. The melting point may be measured based on the melting point determined from a crystal melting peak obtained using a differential scanning calorimeter, or by other conventional means.

EXPERIMENTAL

The compositions described in the examples were made up by the procedure set out below, and made up into molded plaques measuring 150 mm square by 2 mm thick, one face being plaques measuring 150 mm square by 2 mm thick, one face being bonded to an XLPE block of the same dimensions and the two compositions cured together in the press for 20 minutes at 180° C. In each case adhesion was measured by the peel strength tests detailed below. Identification of ingredients also follows.

Batches of about 1350 g (3.3 lb) of each composition were made up using a Farrell model BR Banbury mixer with a capacity of 1.57 1. All of the ingredients were added to the Banbury mixer and the ram was lowered. They were then mixed for two minutes at the middle speed setting. The mixture was discharged, milled into a flat sheet and promptly molded.

Plaque samples were tested by cutting completely through the thickness of the layer of the experimental shield composition in parallel lines to define a strip 12.5 m (½ inch) wide; one end was lifted and turned back 180° to lie along the surface of the portion still adhered, and the force required to peel at a rate of 0.0085 m/s (20 in/min) measured; peel strength was calculated in pounds per ½ inch.

Results

Comparative Examples A through G shown in Table I are the adhesion results on plaques for compositions having either having no adhesion modifying additive (A) or a single type of adhesion modifying additive, such as an EVA wax (B & C), one amide wax (D, E & G), or combination of two amide waxes (F). It can also be seen that 14% EVA wax yields the best results in Table I, however as stated above, 14% EVA wax is an expensive material.

TABLE I

| | | | COMPARATIVE EXAMPLES Results on Plaques | | | | | | |
|---|---|---|---|---|---|---|---|---|---|
| FORMULATION | DSC peak melt point C. | Gardner color | A | B | C | D | E | F | G |
| 33% VA EVA 33 Mi | | | 62 | 58 | 58 | 59.0 | 59.0 | 59.0 | 59.0 |
| N550 Carbon Black | | | 37 | 37 | 37 | 37.00 | 37.00 | 37.00 | 37.00 |
| 11% EVA wax | | | | 4 | | | | | |
| 14% EVA wax | | | | | 4 | | | | |
| Zn stearate | | | 0.5 | 0.5 | 0.5 | 0.5 | 0.5 | 0.5 | 0.5 |
| Trimethylquinoline antioxidant | | | 0.5 | 0.5 | 0.5 | 0.5 | 0.5 | 0.5 | 0.5 |
| Stearyl erucamide | 70-75 | 5 | | | | 3.0 | | | |
| Refined erucamide | 78-81 | 2 | | | | | | | 3.0 |
| Ethylene bis-oleamide | 115-125 | 10 | | | | | | 1.5 | |
| Refined oleamide | 70-73 | 2 | | | | | | | |
| Ethylene bis-stearamide | 140-145 | 5 | | | | | 3.0 | 1.5 | |
| Tertbutyl cumyl peroxide | | | 1 | 1 | 1 | 1 | 1 | 1 | 1 |
| TOTAL | | | 101 | 101 | 101 | 101 | 101 | 101 | 101 |
| Adhesion per ½ in | | | 18.0 | 12.0 | 8.0 | 13.3 | 8.71 | 10.8 | 11.8 |

Examples 1 through 8 shown in Table II are the adhesion results on plaques for compositions in accordance with the invention. In all instances, the invention is an improvement over both the performance of the single type of prior art adhesion modifying additive and an improvement over the cost of the prior art adhesion modifying additives.

TABLE II

| FORMULATION | DSC peak melt point C. | Gardner color | EXAMPLES Results on Plaques 1 | 2 | 3 | 4 | 5 | 6 | 7 | 8 |
|---|---|---|---|---|---|---|---|---|---|---|
| 33% VA EVA 33 Mi | | | 55.0 | 55.0 | 55.0 | 55.0 | 55.0 | 55.0 | 55.0 | 55.0 |
| N550 Carbon Black | | | 37.0 | 37.0 | 37.0 | 37.0 | 37.0 | 37.0 | 37.0 | 37.0 |
| 11% EVA wax | | | 4.0 | 4.0 | 4.0 | 4.0 | 4.0 | 4.0 | 4.0 | 4.0 |
| Zn stearate | | | 0.5 | 0.5 | 0.5 | 0.5 | 0.5 | 0.5 | 0.5 | 0.5 |
| Trimethylquinoline antioxidant | | | 0.5 | 0.5 | 0.5 | 0.5 | 0.5 | 0.5 | 0.5 | 0.5 |
| Stearyl erucamide | 70-75 | 5 | | | | 3.0 | | | | |
| Refined erucamide | 78-81 | 2 | | | | | 3.0 | | | |
| Ethylene bis-oleamide | 115-125 | 10 | | | 3.0 | | | | | 1.5 |
| Refined oleamide | 70-73 | 2 | 3.0 | | | | | | | |
| Ethylene bis-stearamide | 140-145 | 5 | | 3.0 | | | | | 5.0 | 1.5 |
| Oleyl palmitamide | 102-112 | 4 | | | | | | 3.0 | | |
| Tert butyl cumyl peroxide | | | 1 | 1 | 1 | 1 | 1 | 1 | 1 | 1 |
| TOTAL | | | 101 | 101 | 101 | 101 | 101 | 101 | 101 | 101 |
| Adhesion per ½ in | | | 3.6 | 4.4 | 8.0 | 5.8 | 4.0 | 6.7 | 7.9 | 6.6 |

Comparative Examples H through K shown in Table III are the adhesion results on plaques for compositions having EVA wax as a single type of adhesion modifying additive. They clearly demonstrate that increasing the amount of a single type of adhesion modifying additive above 2.5 weight percent has little or no positive effect. Moreover, at levels of 10 weight per cent, performance dramatically decreases. Thus, Comparative Examples H through K also show (when compared to Table II) that the two-part strippable additives in accordance with the invention clearly have a synergistic effect. In particular, the total amount of adhesion modifying additive in accordance with the invention for Examples 1-6 & 8 is approximately 7 weight percent, of which approximately 4 weight percent is 11% EVA wax. The adhesion results for the adhesion modifying additive in accordance with invention are dramatically improved when compared to the similar amounts of 11% EVA wax shown in Table III.

TABLE III

| FORMULATION | COMPARATIVE EXAMPLES Results on Plaques H | I | J | K |
|---|---|---|---|---|
| 33% VA EVA 33 Mi | 59.5 | 57 | 54.5 | 52 |
| N351 Carbon Black | 37 | 37 | 37 | 37 |
| 11% EVA wax | 2.5 | 5 | 7.5 | 10 |
| Zn stearate | 0.5 | 0.5 | 0.5 | 0.5 |
| Trimethylquinoline antioxidant | 0.5 | 0.5 | 0.5 | 0.5 |
| Adhesion per ½ in | 10.5 | 10 | 9.5 | 15 |

Comparative Example L in Table IV shows the adhesion results on cable for a composition having an expensive 14% EVA wax. Examples 9 and 10 in Table IV show the adhesion results on cables for compositions in accordance with the invention. In all instances, the invention exceeds the performance of the prior art adhesion modifying additives.

TABLE IV

| FORMULATION | Results on Cable L | 9 | 10 |
|---|---|---|---|
| 33% VA EVA 33 Mi | 58 | 57 | 55.5 |
| N550 Carbon Black | 37 | 37 | 37 |
| 11% EVA wax Mw 15,000 | | | 4 |
| 14% EVA wax Mw 25,000 | 4 | 4 | |
| Zn stearate | 0.5 | 0.5 | 0.5 |
| Trimethylquinoline antioxidant | 0.5 | 0.5 | 0.5 |
| Ethylene bis-oleamide | | 0.5 | 1.25 |
| Ethylene bis-stearamide | | 0.5 | 1.25 |
| Tert butyl cumyl peroxide | 1 | 1 | 1 |
| Adhesion per ½ in | 14 | 12 | 9 |

These experimental data are by no means exhaustive of the possible formulations or results encompassed by the invention. For this reason, reference should be made solely to the appended claims for the purposes of determining the true scope of this invention.

What is claimed is:

1. A semiconductive composition for use as a strippable semiconductive insulation shield layer in contact with an outermost surface of a wire and cable insulation layer, said composition comprising:

40 to 85 weight percent, based upon the weight of the semiconductive composition, of a base polymer having a weight average molecular weight of not more than 200,000: and an adhesion modifying additive system comprising at least two components, each of said adhesion modifying additive system components being different from said base polymer, said first component comprising a hydrocarbon wax or ethylene vinyl acetate wax and said second component comprising an amide wax; and 5 to 45 weight percent, based upon the weight of the semiconductive resin composition, of a conductive carbon black.

2. The semiconductive composition of claim 1, wherein the base polymer is selected from the group consisting of ethylene vinyl acetate copolymers, ethylene alkyl acrylate copolymers wherein the alkyl group is selected from C1 to C6 hydrocarbons, ethylene alkyl methacrylate copolymers; wherein the alkyl group is selected from C1 to C6 hydrocarbons and ethylene alkyl acrylate alkyl methacrylate terpolymers; and wherein the alkyl group is independently selected from C1 to C6 hydrocarbons, and mixtures thereof.

3. The semiconductive composition of claim 2, wherein the base polymer comprises ethylene vinyl acetate copolymer.

4. The semiconductive resin composition of claim 3, wherein said ethylene vinyl acetate has from about 28% to about 40% vinyl acetate.

5. The semiconductive composition of claim 1, wherein the first component of the adhesion modifying additive system is an ethylene vinyl acetate wax having a vinyl acetate content of from about 10% to about 20% vinyl acetate.

6. The semiconductive composition of claim 1, wherein said amide wax is selected from stearamide, oleamide, erucamide, ethylene bis-stearamide, ethylene bis-oleamide, ethylene bis-erucamide, behenamide, oleyl palmitamide and mixtures thereof

7. The semiconductive composition of claim 1, wherein said amide wax is about 0.5 to about 5 weight percent, based upon the weight of the semiconductive composition.

8. The semiconductive composition of claim 1, wherein said amide wax is about 1 to about 3 weight percent, based upon the weight of the semiconductive composition.

9. The semiconductive composition of claim 1, wherein said ethylene vinyl acetate wax is about 0.5 to about 5 weight percent, based upon the weight of the semiconductive composition.

10. The semiconductive composition of claim 1, wherein said ethylene vinyl acetate wax is about 1 to about 3 weight percent, based upon the weight of the semiconductive composition.

11. A conductive cable comprising:

a centrally located conductive core;

an insulation layer external to said conductive core; and a strippable semiconductive insulation shield layer in contact with an outermost surface of said insulation layer, said insulation shield layer comprising;

40 to 85 weight percent, based upon the weight average molecular weight of not more than 200,000; and an adhesion modifying additive system comprising at least two components, each of said an adhesion modifying additive system components being different from said base polymer, said first component comprising a hydrocarbon wax or ethylene vinyl acetate wax and said second component comprising an amide wax; and 5 to 45 weight percent, based upon the weight of the semiconductive resin composition, of a conductive carbon black.

12. The conductive cable of claim 11, wherein the base polymer is selected from the group consisting of ethylene vinyl acetate copolymers, ethylene alkyl acrylate copolymers wherein the alkyl group is selected from C1 to C6 hydrocarbons, ethylene alkyl methacrylate copolymers; wherein the alkyl group is selected from C1 to C6 hydrocarbons and ethylene alkyl acrylate alkyl methacrylate terpolymers; and wherein the alkyl group is independently selected from C1 to C6 hydrocarbons, and mixtures thereof

13. The conductive cable of claim 12, wherein the base polymer comprises ethylene vinyl acetate copolymer.

14. The conductive cable composition of claim 13, wherein said ethylene vinyl acetate has from about 28% to about 40% vinyl acetate.

15. The conductive cable of claim 11, wherein the first component of the adhesion modifying additive system is an ethylene vinyl acetate wax having a vinyl acetate content of from about 10% to about 20% vinyl acetate.

16. The conductive cable of claim 11, wherein said amide wax is selected from stearamide, oleamide, erucamide, ethylene bis-stearamide, ethylene bis-oleamide, ethylene bis-erucamide, behenamide, oleyl palmitamide and mixtures thereof.

17. The conductive cable of claim 11, wherein said amide wax is about 0.5 to about 5 weight percent, based upon the weight of the semiconductive composition.

18. The conductive cable of claim 11, wherein said amide wax is about 1 to about 3 weight percent, based upon the weight of the semiconductive composition.

19. The conductive cable of claim 11, wherein said ethylene vinyl acetate wax is about 0.5 to about 5 weight percent, based upon the weight of the semiconductive composition.

20. The conductive cable of claim 11, wherein said ethylene vinyl acetate wax is about 1 to about 3 weight percent, based upon the weight of the semiconductive composition.

21. A semiconductive composition for use as a strippable semiconductive insulation shield layer in contact with an outermost surface of a wire and cable insulation layer, said composition comprising;

40 to 85 weight percent, based upon the weight of the semiconductive composition, of a base polymer having a weight average molecular weight of not more than 200,000; and wherein the base polymer is a copolymer of ethylene and a mono-unsaturated ester where the mono-unsaturated ester content is between 28% and 40%; and an adhesion modifying additive system comprising at least two components, each of said adhesion modifying additive system components being different from said base polymer, said first component comprising a hydrocarbon wax or ethylene vinyl acetate wax and said second component comprising an amide wax; and 5 to 45 weight percent, based upon the weight of the semiconductive resin composition, of a conductive carbon black.

22. The semiconductive composition of claim 21, wherein the base polymer is selected from the group consisting of ethylene vinyl acetate copolymers, ethylene alkyl acrylate copolymers; wherein the alkyl group is selected from C1 to C6 hydrocarbons, ethylene alkyl methacrylate copolymers; wherein the alkyl group is selected from C1 to C6 hydrocarbons and ethylene alkyl acrylate alkyl methacrylate terpolymers; and wherein the alkyl group is independently selected from C1 to C6 hydrocarbons, and mixtures thereof.

23. The semiconductive composition of claim 22, wherein the base polymer comprises ethylene vinyl acetate copolymer.

24. A semiconductive composition for use as a strippable semiconductive insulation shield layer in contact with an outermost surface of a wire and cable insulation layer, said composition comprising:

40 to 85 weight percent, based upon the weight of the semiconductive composition, of a base polymer having a weight average molecular weight of not more than 200,000; and an adhesion modifying additive system comprising at least two components, each of said adhesion modifying additive system components being different from said base polymer, said first component comprising a hydrocarbon wax or ethylene vinyl acetate wax and said second component comprising an amide wax; and 5 to 45 weight percent, based upon the weight of the semiconductive resin composition, of a conductive carbon black;

wherein the semiconductive composition gives an adhesion result on plaques of less than about 8.0 pounds per ½ inch.

* * * * *